US005568801A

United States Patent [19]

Paterson et al.

[11] Patent Number: 5,568,801

[45] Date of Patent: Oct. 29, 1996

[54] PLASMA ARC IGNITION SYSTEM

[75] Inventors: John Paterson; Robert Kaldenbach; John Unsworth, all of Ontario, Canada

[73] Assignee: Ortech Corporation, Ontario, Canada

[21] Appl. No.: 255,754

[22] Filed: May 20, 1994

Related U.S. Application Data

[63] Continuation-in-part of PCT/CA92/00510, Nov. 23, 1992.

[51] Int. Cl.[6] ..... F02P 9/00; F02P 5/00

[52] U.S. Cl. ..... 123/598; 123/620; 123/143 B

[58] Field of Search ..... 123/143 B, 598, 123/602, 606, 607, 620, 654, 418, 627

[56] References Cited

U.S. PATENT DOCUMENTS

| | | | |
|---|---|---|---|
| 3,919,993 | 11/1975 | Neuman | 123/620 |
| 4,122,816 | 10/1978 | Fitzgerald et al. | 123/598 |
| 4,317,068 | 2/1982 | Ward et al. | 123/627 |
| 4,345,575 | 8/1982 | Jorgensen | 123/598 |
| 4,366,801 | 1/1983 | Endo et al. | 123/606 |
| 4,369,757 | 1/1983 | Anzai | 123/620 |
| 4,398,526 | 8/1983 | Hamai et al. | 123/606 |
| 4,677,960 | 7/1987 | Ward | 123/598 |
| 4,739,185 | 4/1988 | Lee et al. | 123/620 |
| 4,909,228 | 3/1990 | Wainwright | 123/607 |
| 4,996,967 | 3/1991 | Rosswurm et al. | 123/598 |
| 4,998,526 | 3/1991 | Gokhale | 123/598 |
| 5,131,376 | 7/1992 | Ward et al. | 123/598 |
| 5,179,928 | 1/1993 | Cour et al. | 123/606 |

FOREIGN PATENT DOCUMENTS

| | | |
|---|---|---|
| 0 228 840 | 7/1987 | European Pat. Off. . |
| 0 463 800 | 1/1992 | European Pat. Off. . |

OTHER PUBLICATIONS

L. A. Gussak (1965), v.1, No. 4, A New Principle of Ignition And Combustion For Internal Combustion Engines, L. A. Houssak (Moscow), Mar. 1965.

R. Maly and M. Vogel, "Initiation and Propagation of Flame Fronts in Lean $CH_4$–Air Mixtures by the Three Modes of the Ignition Spark", Inhibition & Ignition, Jan. 1981.

R. M. Clements, P. R. Smy and J. D. Dale (1981), "An Experimental Study of the Ejection Mechanism for Typical Plasma Jet Igniters", Combustion & Flame, Jan. 1981.

J. D. Dale and A. K. Oppenheim (1981), "Ehanced Ignition for I.C. Engines with Premixed Gases", SAE, Feb. 23–27, 1981.

D. J. Fitzgerald (1976), "Pulsed Plasma Ignitor for Internal Combustion Engines", SAE, Oct. 18–22, 1976.

R. W. Johnston, J. G. Neuman and P. D. Agarwal (1975), "Programable Energy Ignition System for Engine Optimization", SAE, Feb. 24–28, 1975.

*Primary Examiner*—Willis R. Wolfe

*Attorney, Agent, or Firm*—Shoemaker and Mattare, Ltd.

[57] ABSTRACT

An ignition system for igniting fuel within an engine, comprising at least one ignition plug disposed in the engine, wherein the ignition plug has a pair of electrodes. A high voltage generator is connected to the ignition plug for applying a gated high voltage high frequency AC signal across the pair of electrodes so as to initiate ionization of the air/fuel mixture and create an infant plasma channel between the pair of electrodes. A plasma arc current generator is connected to the ignition plug for generating a predetermined magnitude of alternating current for a predetermined period of time so as to sustain the plasma channel and ignite the fuel, and a controller is provided for selectively enabling and disabling the high voltage generator and the plasma arc current generator at predetermined times.

12 Claims, 10 Drawing Sheets

PLASMA ARC IGNITION SYSTEM

CROSS-REFERENCE TO RELATED APPLICATION

This is a continuation-in-part of PCT International Application No. PCT/CA/92/00510 filed Nov. 23, 1992.

FIELD OF THE INVENTION

This invention relates in general to ignition systems for fuel powered engines. More particularly, the invention relates to an adaptive plasma ignition system with bipolar arc mode current control.

BACKGROUND OF THE INVENTION

Considerable prior art literature is available on the subject of spark ignition systems. Existing spark ignition systems for automobiles date back to about 1905. Although modern materials such as plastics and semiconductors have been used to improve the efficiency of the sparking coil, there has been little improvement to the basic principle, which provides for a 30 KV spark across two electrodes in the gasoline cylinder of the engine to ignite the fuel mixture. The single point ignition process effected by well known prior art spark plugs results in a slow moving flame-front across the engine cylinder. The speed of combustion resulting from this slow moving flame front necessitates advancing initiation of the spark as the engine speed increases, resulting in loss of power.

As is well known, diesel engines do not use spark plugs. Instead, fuel is injected into a preheated cylinder and is ignited by heat of compression. Similarly, high performance racing engines use glow plugs and doped alcohol fuels which tend to auto-ignite in a similar manner as the diesel principle, thereby achieving efficiency and performance significantly higher than spark ignition gasoline engines.

By the late 1970's, the effectiveness of plasma ignition systems was well accepted (L. A. Gussak (USSR), Energetikco Transport Academy Izvestijia (1965), Vol. No. 4, pp. 98–110 "New Principle of Ignition and Combustion in Engines"). However, as was also recognized at that time, the practical aspects of the application of plasma ignition systems to engines would require considerable further engineering research to qualify data on fuel economy, emissions and the LML (lean misfits limit).

Extensive research has been conducted in the characterization of plasma jet igniters, specifically at the lean misfire limit. The work of J. D. Dale at the University of Alberta, Edmonton, and A. K. Oppenheim at the University of California, Berkeley, and D. Fitzgerald at Jet Propulsion/CALTECH, stand out as the definitive and authoritative work leading to a true understanding of the application, benefits and superiority of plasma jet ignition over conventional spark ignition, for low-emission lean-burn engines. However, the practical implementation of such systems has been encumbered by severe hardware constraints and rapid electrode erosion, and as such, commercialization of such systems has not taken place.

Additional relevant prior art is disclosed in various issued patents.

U.S. Pat. No. 4,996,967 (Cummins Engine Company, Inc.) discloses an apparatus and method for generating a highly conductive channel for the flow of plasma current, in which a pre-pulse is utilized to ensure that an ionized channel is developed to a significantly conductive state prior to application of a current for sustaining of the plasma arc. However, according to the '967 Patent, the pre-pulse signal is in the form of a simple DC pulse. It has been found that the use of a single DC pulse may not always provide the best possible efficiency for ensuring complete ionization prior to onset of the plasma current.

U.S. Pat. No. 5,179,928 (Siemens Aktingeschellschaft) discloses means for generating an alternating current high voltage signal which is derived from a bipolar switcher with a tuned transformer section. The frequency of operation is adjusted when the spark plug operates in the plasma arc mode.

U.S. Pat. No. 4,998,526 (General Motors) discloses means for adjusting the plasma arc duration and magnitude of the plasma arc current in a fixed, non-adaptive manner. The arc current is maintained constant irrespective of the applied engine load.

SUMMARY OF THE INVENTION

Whereas most of the prior art relates to functional improvements in spark ignition technology, the present invention is directed to the problems of adaptable plasma arc energy delivery and spark timing to achieve optimum engine combustion over a wide range of engine types, fuels, atmospheric conditions and operating parameters, and reducing erosion at the plasma plugs due to prior art unipolar operation.

BRIEF DESCRIPTION OF THE DRAWINGS

A further discussion of the prior art and a description of the preferred embodiment are provided herein below with reference to the following drawings in which.

DETAILED DESCRIPTION OF THE PREFERRED EMBODIMENT AND OF THE PRIOR ART

Figure 1A:
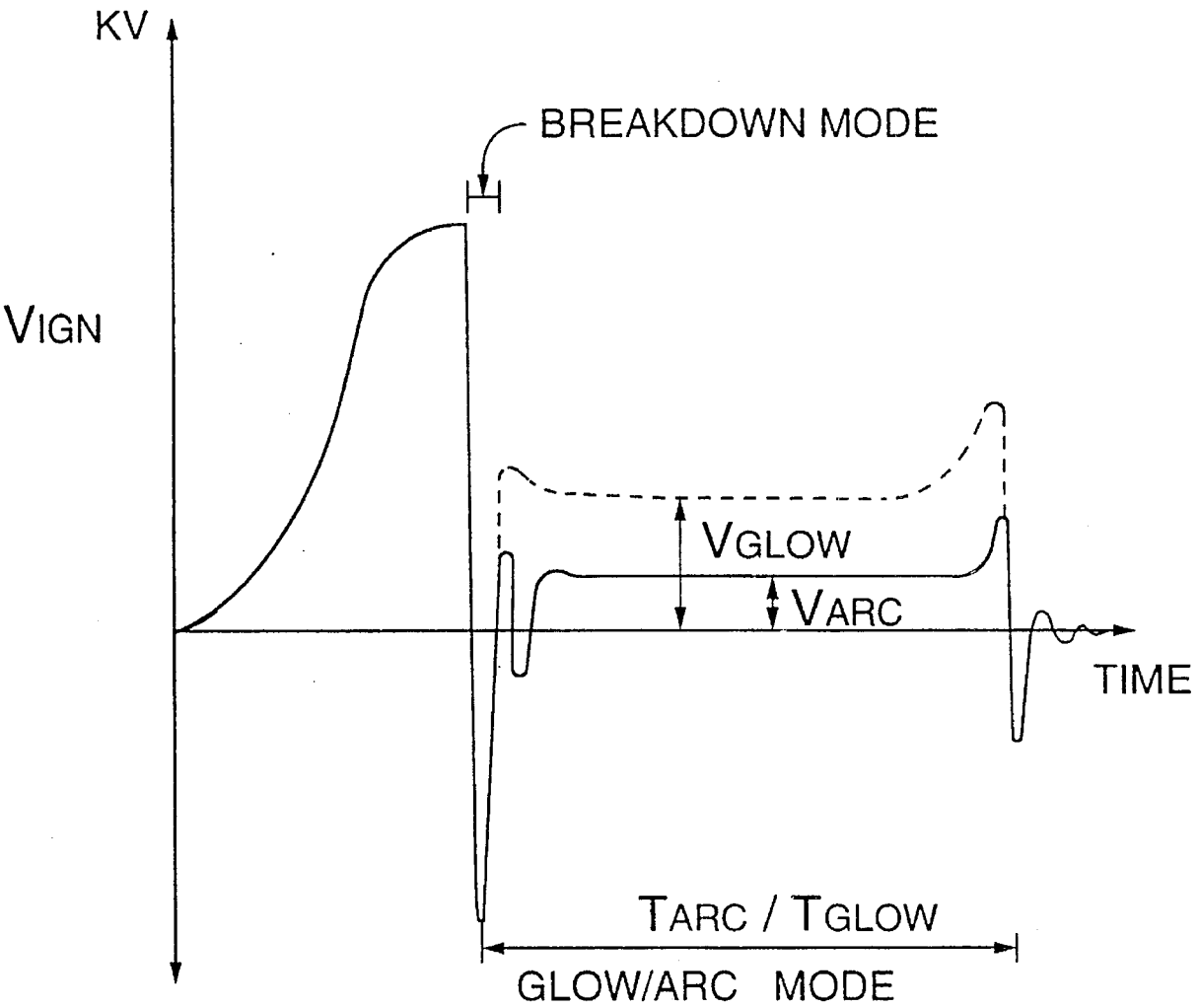
FIG. 1A shows a typical waveform for a unipolar ignition system operating in either the glow mode or the arc mode.

Before discussing prior art systems and the present invention in detail, a brief description of the physical phenomena by which thermal ignition occurs is provided, with reference to FIG. 1A. Initially, a voltage is applied across both electrodes (anode and cathode) on either side of the discharge gap containing a combustible gas mixture. As the voltage increases, electrons and ions are attracted to and move toward the charged electrodes so as to collide with neutral atoms within the gas, thereby creating further ionization and increasing the ion density in the gap. This process continues until the voltage applied across the electrodes exceeds the voltage at which channel breakdown occurs (breakdown mode). Plasma channel formation occurs during the breakdown mode.

There is a brief period of oscillation during the breakdown mode, after which the arc mode is established. The arc mode is characterized by a low impedance channel and high current flow therewithin.

The plasma arc mode can only be sustained provided that the magnitude of the arc current remains greater than 150 mA. Currents less than 150 mA cause a transition from the arc to the glow mode exhibiting a much higher "arc" voltage.

Energy delivered to the arc can be controlled by modifying the magnitude of the arc current and its duration, based on measurement of engine specific parameters.

Figure 1B:
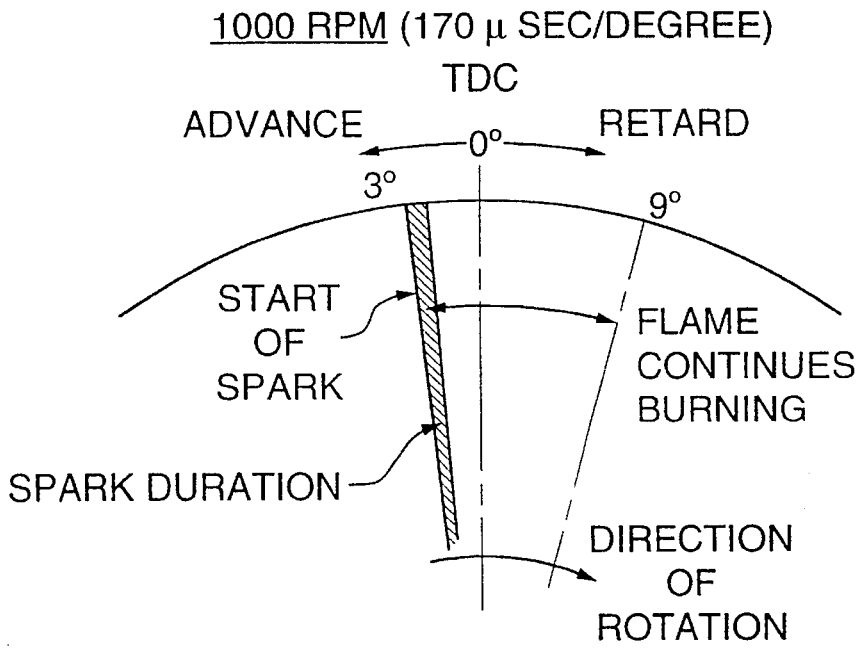
FIGS. 1B and 1C show a typical combustion cycle of a modern internal combustion engine.
Figure 1C:
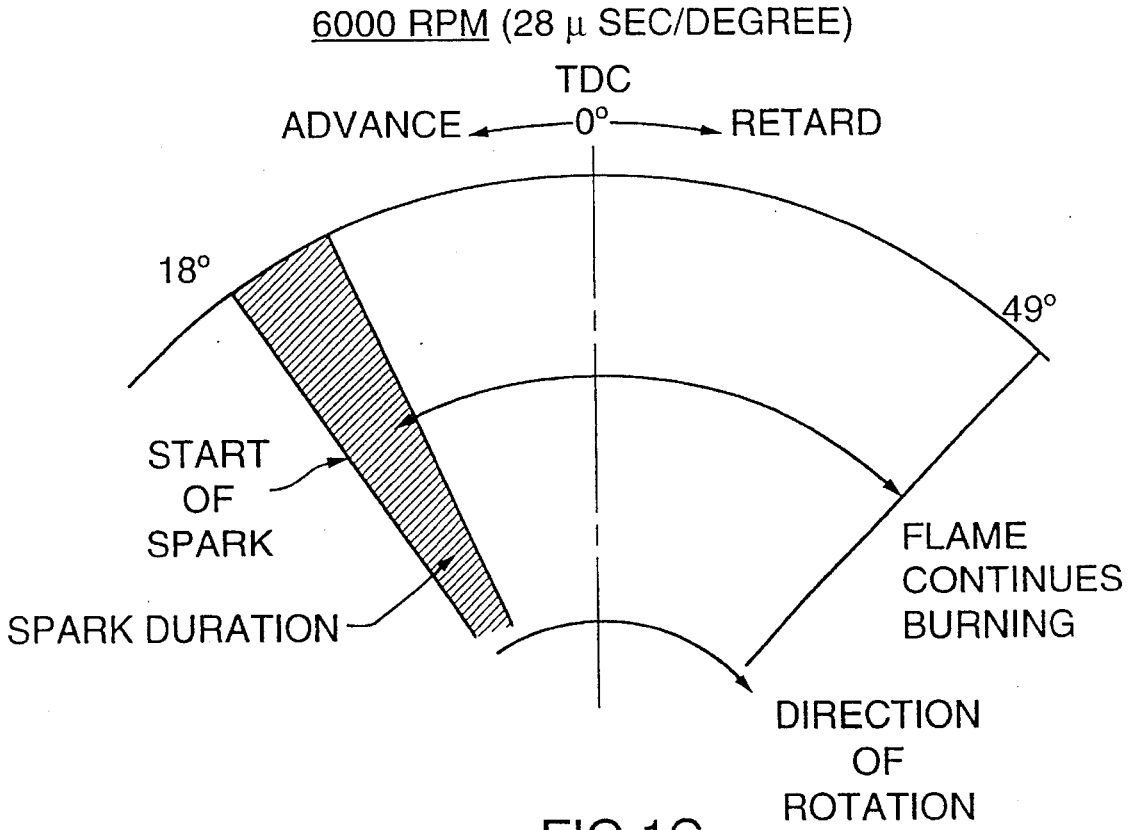

FIGS. 1B and 1C show the typical combustion cycle of a modern 6-cylinder 3.3 liter gasoline four-stroke internal combustion engine, with the different timing effects on the combustion process at 1000 rpm and 6000 rpm, respectively. The red-line for engines in normal use occurs at 6000 rpm, while 1000 rpm is slightly over the off-load idle condition.

Figure 2A:
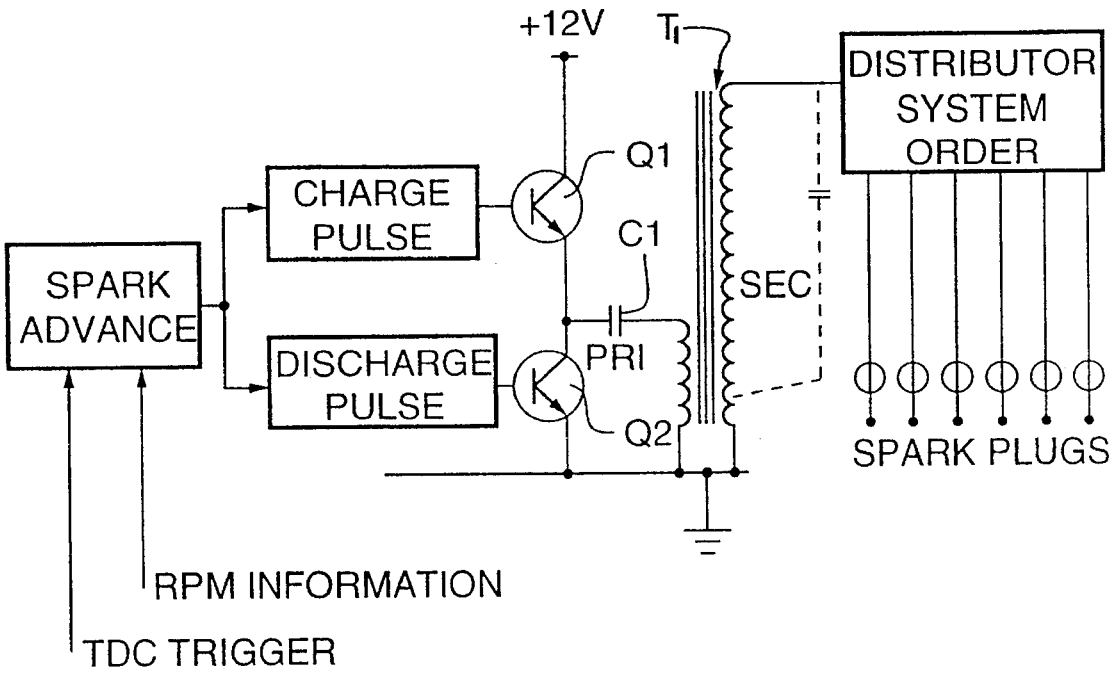
FIG.2A (PRIOR ART)
FIGS. 2A and 2B show a typical modern electronic ignition system and the associated timing waveforms, respectively.
Figure 2B:
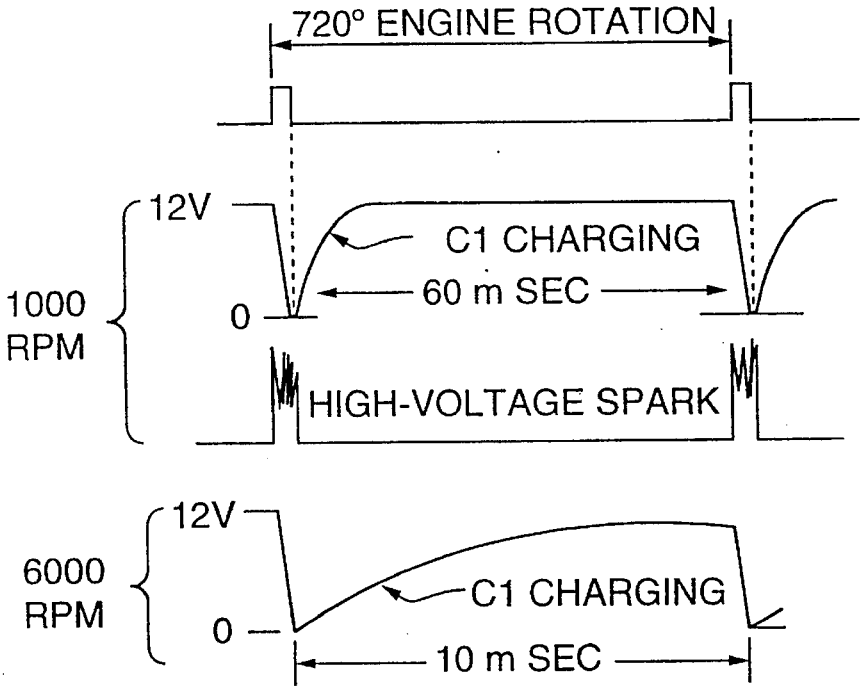
FIG.2B (PRIOR ART)

FIG. 2A shows the typical prior art electronic ignition system used to create the ignition spark, and FIG. 2B shows the associated timing waveform at 1000 RPM and at 6000 RPM for a single cylinder engine.

As shown in FIG. 2A, prior art ignition systems incorporate a capacitor C1 which is charged up to 12 V, for example, through transistor Q1. This occurs during the "off" cycle between Top Dead Centre (TDC) pulses. The charging circuit has to be designed such that the capacitor C1 can be fully charged between sparks at the maximum speed of the engine, which allows about 10 milliseconds (0.010 sec) for full charge. At the TDC pulse spark time, the pulse triggers a discharge circuit comprising transistor Q2, which discharges the capacitor C1 rapidly through the primary of transformer T1. Transformer T1 typically has a step-up ratio of 1:100. The rapid discharge of current through the primary coil of T1 coupled with the resonance effects caused by the LC combination of C1-T1 reactances multiplies the circulating current by up to 20 times, resulting in a 25–30 kV spark. The T1 secondary coil may be manufactured with additional or designed-in capacitances (shown dotted) to cause resonance effects in the secondary windings of T1 (the high-voltage side). Once the discharging of C1 is complete, the breakdown phase is completed, and C1 starts charging again.

The typical advantages of such ignition systems are that they are simple, low-cost and safe. Inherent high-resistance in T1 is claimed as a safety feature, together with the high-resistance plug-leads, and series resistor built in the plug. However, the inherent high-resistance of all of the components prevents the efficient delivery of higher energies (current limited) to the spark plug. The typical energy delivered per spark is about 0.020 Joules, whereas the typical energy stored by the capacitor C1 is about 0.100 Joules, so that the process is seen to be only about 20% efficient.

Referring again to FIG. 1B and 1C, which show the typical combustion cycle for a four-stroke engine, it can be seen that at 1000 rpm (slow speed, no-load), conditions appear to be near ideal (FIG. 1B). The rotation speed is 170 usec microseconds per degree; the spark time of 11 microseconds=0.58 degrees; an advance of 3 degrees is all that is needed for efficient combustion where the combustion flame burning time is about 1.5 milliseconds or 8.8 degrees.

However, at mid range, 3000–6000 rpm (max speed, full load), conditions are marginal (FIG. 1C). The rotation speed is 28 microseconds per degree; the spark time is 100 microseconds or 3.6 degrees; an advance of 9 degrees is needed at 3000 rpm; an advance of 18 degrees needed at 6000 rpm; and combustion flame burning time takes about 1.5 milliseconds or 53.6 degrees (6000 rpm).

The inventors have recognized that significant improvements can be made. One objective of an aspect of the present invention is to provide means for delivering a controllable amount of energy to the plasma arc, which is defined by engine specific parameters. The amount of energy delivered to the plasma arc immediately after the breakdown phase, is defined according to the present invention, by two independent parameters:

a) magnitude of the arc current b) magnitude of the arc period.

The arc voltage is assumed to remain, within reasonable limits, constant as a function of arc current magnitude, which was confirmed in the system of the present invention by real-time measurements. Hence the power dissipated by the plasma-arc can be controlled by the magnitude of the arc current injection. Plasma arc energy is controlled by the product of arc power and arc duration.

This degree of control allows the spark advance angle to be reduced, resulting in more power, better fuel efficiency as well as lower emissions. Due to the fact that the energy delivered to the plasma arc is substantially greater than in prior art systems, an increase in the plasma flame front velocity can be realized. This increase in the flame front velocity results in a greater pressure rise per unit of time, $$\left(\text{combustion pressure slew rate} - \frac{dPc}{dt}\right)$$

Figure 3:
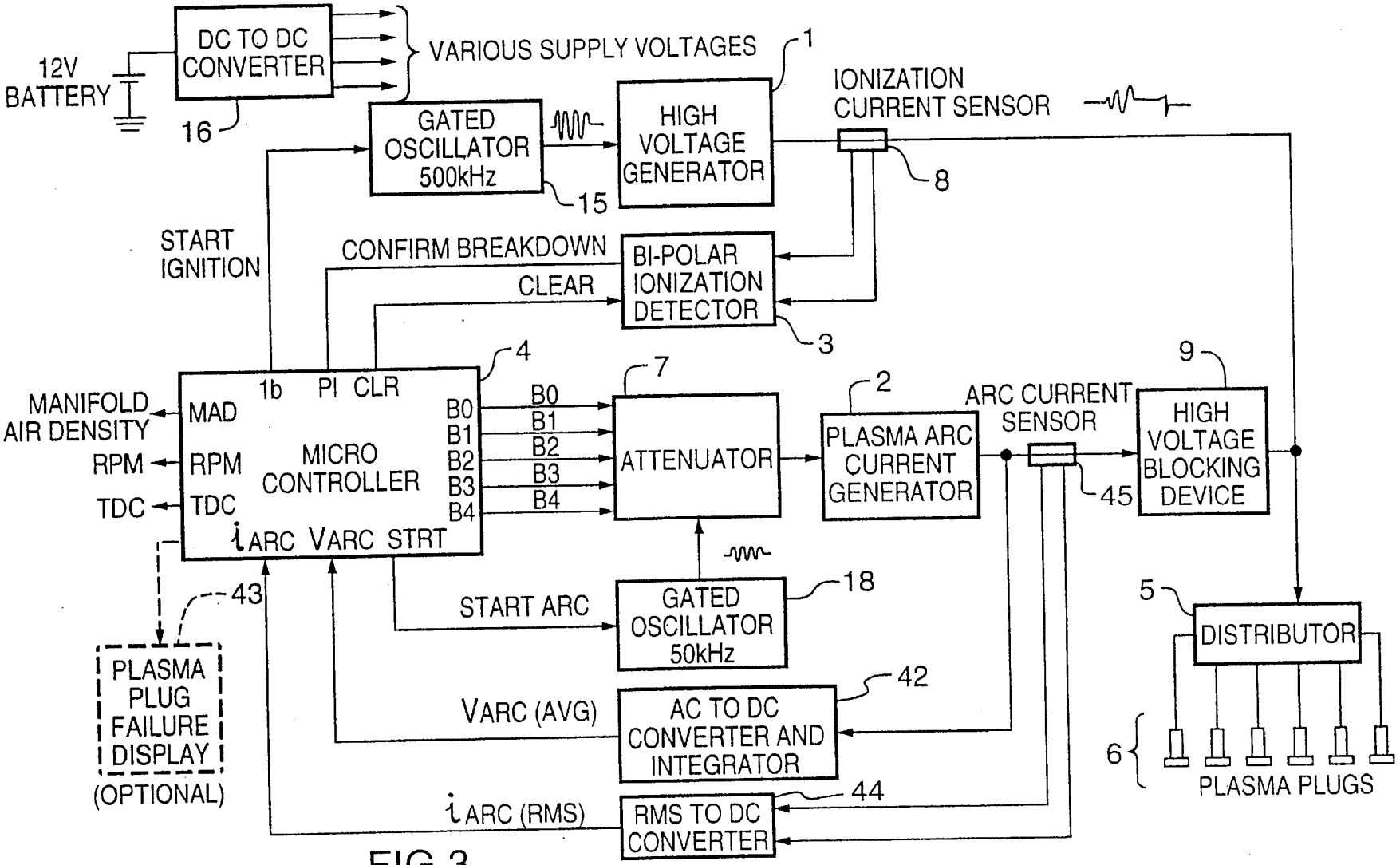
FIG. 3 is a block diagram of a plasma arc ignition system according to the present invention.

Turning to FIG. 3, a plasma arc ignition system is shown according to the present invention having a high voltage generator 1 coupled to a low impedance plasma arc current generator 2. Both generators are controlled by a controller 4 (eg. microcontroller) operating in response to engine specific parameters and in accordance with internal algorithms.

Both the high voltage generator 1 and plasma arc current generator 2 operate on the principle of alternating current, thereby substantially alleviating the problem of uni-directional plug erosion in prior art unipolar ignition systems. At the beginning of each ignition cycle, the controller 4 generates a timing signal for operation of the high voltage generator 1. The high-voltage generator 1 receives the ignition timing pulse from the controller 4 (via gated oscillator 15) and immediately initiates an alternating high voltage with a rapidly increasing amplitude, causing a discharge to take place at approximately 20 to 35 KV.

An ionization current detector 3 detects when breakdown (ionization) has taken place, and provides an output signal to the controller 4, so that the controller can initiate the immediate supply of energy to the infant plasma channel to sustain the plasma arc phase.

The ionization current detector is connected to a sensor 8 which is connected in series with the high-voltage generator 1 and distribution system 5. The ionization current detector 3 detects a sudden increase in the breakdown discards current defined by the plasma plug 6. It is at this time that the conditions exist for an infant plasma channel. The breakdown discharge signal is sent to the controller 4, which in response immediately turns on the high-current generator 2 thereby injecting current into the infant plasma channel.

Operation of the plasma arc current generator 2 is adaptively controlled by the controller 4 in accordance with the engine specific parameters referred to above. The controller 4 receives RPM, TDC timing and manifold air density data from the engine computer and computes the appropriate time to commence ignition and adaptively controls, by means of an empirically defined algorithm, the plasma arc current amplitude and duration of the plasma arc. Thus, the controller 4 preferably includes means for digitizing and processing the received data, and calculating appropriate timing signals for the start of the arc current, magnitude of the arc current and duration of the arc on the basis of empirical formulae operating on the receiving engine parameters. The design of firmware for execution in controller 4 would be a straightforward matter for a person skilled in the art, and is not further discussed herein.

By optimizing the amount of electrical energy delivered to the air/fuel mixture as a function of engine specific parameters, as described above, the rate and probability of combustion is enhanced and the engine can be operated at a greater air/fuel ratio ($\lambda>1$) yielding lower emissions. Furthermore, the system of the present invention allows for a reduction in the advance ignition angle, yielding improved efficiency.

The plasma arc current generator 2 receives its input signal from the output of a binary weighted attenuator 7 which in turn receives an input signal derived from a gated 50 kHZ oscillator 18. The attenuator 7 also receives a 5-bit binary code from controller 4, for providing up to 32 attenuation levels. The 5-bit binary code is derived from five output ports B0–B4, located on the controller.

High current generator 2 receives the gated control signal from attenuator 7 for starting the plasma current at a predetermined current level and duration. A high voltage blocking device 9 prevents feed through of the high voltage signal into the current generator 2 which could otherwise be damaged. The plasma plugs 6 and distribution system 5 are provided with a dedicated plasma current return circuit (not shown) which does not simply connect to the engine block and chassis. The distribution system 5 distributes the plasma energy to the plugs 6, and as such is required to be a very low impedance device. The design and construction of the plasma plugs is discussed in applicant's published PCT International Application No. PCT/CA/92/00510.

Figure 4:
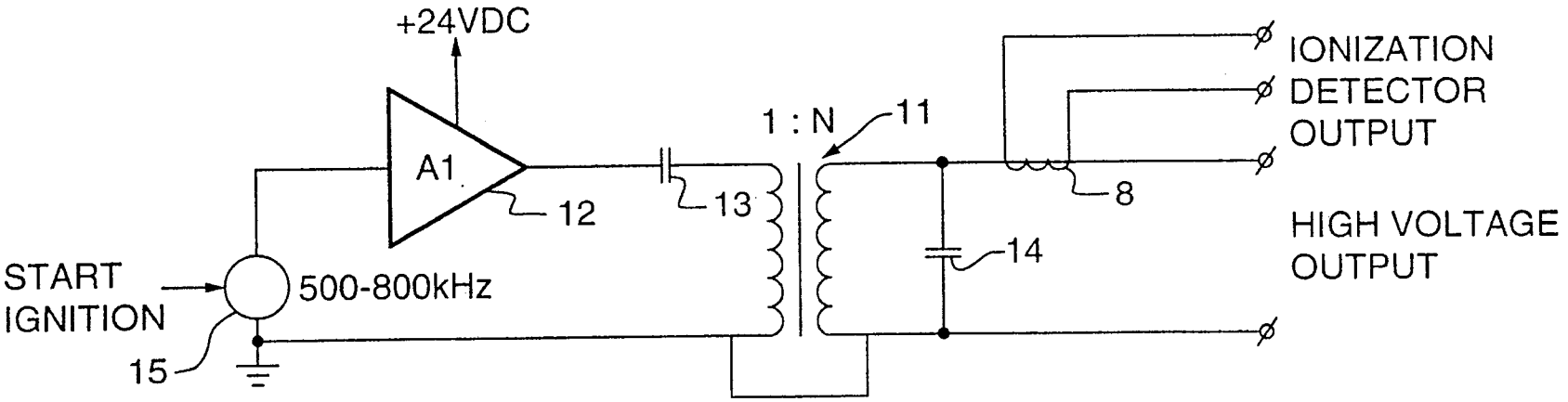
FIG. 4 is a schematic diagram of a high voltage generator of the plasma arc ignition system of FIG. 3, according to the preferred embodiment.

Turning to FIG. 4, a block diagram is provided of the high voltage generator according to the preferred embodiment. The principal purpose of the high voltage generator 1 is to provide a high voltage to the two electrodes of respective ones of the plasma plugs 6 which are immersed in a combustible air/fuel mixture, thereby causing breakdown of the air/fuel mixture between the electrodes. However, it should be noted that, for a small period of time, energy stored in the plug and cable stray capacitors also contributes to the creation and sustaining of the infant plasma channel during the breakdown process, as discussed in greater detail below.

The generator 1 comprises a high frequency and high voltage transformer 11 (eg. for operation in the frequency range of 500–800 kHz), with a predetermined step-up ratio (eg. in the range of from 1:50 to 1:100). The primary of the high voltage transformer 11 is coupled to a medium power Class B amplifier 12 via a capacitor 13. To ensure a reasonably high voltage output, the Class B amplifier 12 must be operated from a supply voltage of at least +24 V DC, which can be obtained by using a relatively low cost 12 V to 24 V DC-to-DC converter 16 (FIG. 4 ).

The secondary of transformer 11 is connected to a capacitor 14 so as to form a single tuned LC circuit having a quality factor (Q factor) of at least 30. The value of capacitor 14 must be chosen to be at least 10 times greater than the total combined value of stray capacitance provided by the interconnecting high voltage cables, distributor 5 and plasma plugs 6. The combined value of stray capacitance can be found by simple measurement of the interconnecting components used in 4-, 6-and 8-cylinder engines.

The power amplifier 12 receives at its input, a burst of a sinusoidal signal with a frequency of at least 500 kHZ. The burst signal is derived from a gated oscillator 15 (FIG. 3), the topology of which can be based on many choices which are well known in the prior art (eg. LC oscillator, RC oscillator, crystal oscillator, etc.). The oscillator 15 receives an On/Off gating signal (designated in FIG. 3 as START IGNITION) from the controller 4 to start the ignition cycle. Because of the relatively high "Q" factor in the secondary side of transformer 11, the voltage profile developed across capacitor 14 gradually builds up until a maximum output is reached. This signal build up only requires between four and six cycles, and does not impair the timing characteristics of the ignition system. Furthermore, breakdown may occur during either the positive half cycle or the negative half cycle of the high voltage output signal, as discussed in greater detail below. Thus, for an input voltage amplitude of 12 V, a Q factor of 30, and a step-up ratio of 1:100, the voltage output rises to 36 kV.

The high voltage generator 1 does not deliver any additional energy after channel breakdown for sustaining the glow phase, or for that matter the arc phase of ignition. Instead, according to the present invention, a controlled amount of current is provided by the plasma arc current generator 2.

Because of the specific limited purpose of the high voltage generator 1, the high voltage transformer 11 can be constructed to minimum dimensions. Furthermore, since the transformer is operated in a single resonance mode at a relatively high frequency, (e.g. 500 to 800 kHZ), only a very small transformer core is required.

Since the high voltage transformer 11 is not required to deliver any energy to sustain the glow or arc phase, an ionization detector 3 is incorporated which detects the process of breakdown, as described briefly above and in greater detail below. The ionization detector 3 provides a CONFIRM BREAKDOWN signal to the controller 4 which, in response, turns on the plasma arc current generator 2 for immediately supplying a preset arc current amplitude for a preset period of time defined by the engine specific parameters (ie. manifold air density, RPM and TDC).

As discussed above with reference to FIG. 3, an ionization current probe 8 is connected to the output of high voltage generator 1 for providing a signal to the bipolar ionization current detector 3. The sensor or probe 8 can be in the form of an inductive element such as a current transformer or other device capable of being used in applications where the current density is not excessive (eg. a Hall field effect detector).

Figure 5:
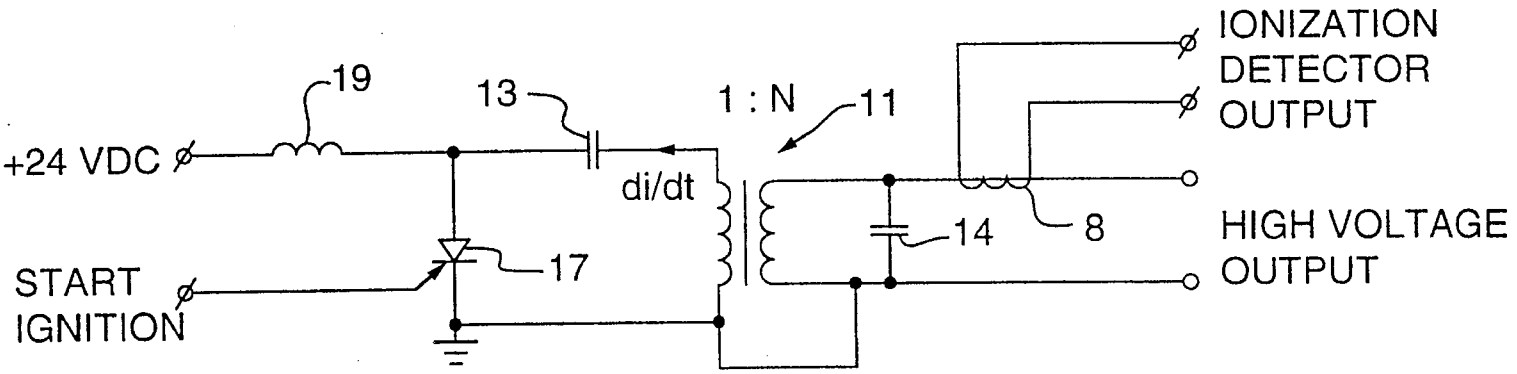
FIG. 5 is a schematic diagram of a high voltage generator according to an alternative embodiment.

Another embodiment of the high voltage generator is shown in FIG. 5, in which a capacitor discharge circuit comprising switch 17 (eg. SCR, IGBT, or MOSFET) is connected to capacitor 13 on the primary side of transformer 11. The secondary side of transformer 11 is configured as in the preferred embodiment of FIG. 4 to form a single tuned LC circuit. In operation, capacitor 13 is first charged to a predetermined level (eg. 24 V). The switch 17 then receives a control signal START IGNITION from controller 4, and in response discharges capacitor 13. The discharging of capacitor 13 results in current flowing through the primary of transformer 11 (di/dt). The primary discharge current (di/dt) induces a current in the secondary of transformer 11 which causes the secondary circuit to enter into an oscillatory self resonance mode which exhibits the same voltage profile across capacitor 14 as in the preferred embodiment. Inductor 19 prevents momentary short circuiting of the +24 V DC power supply when switch 17 is turned on.

Figure 6A:
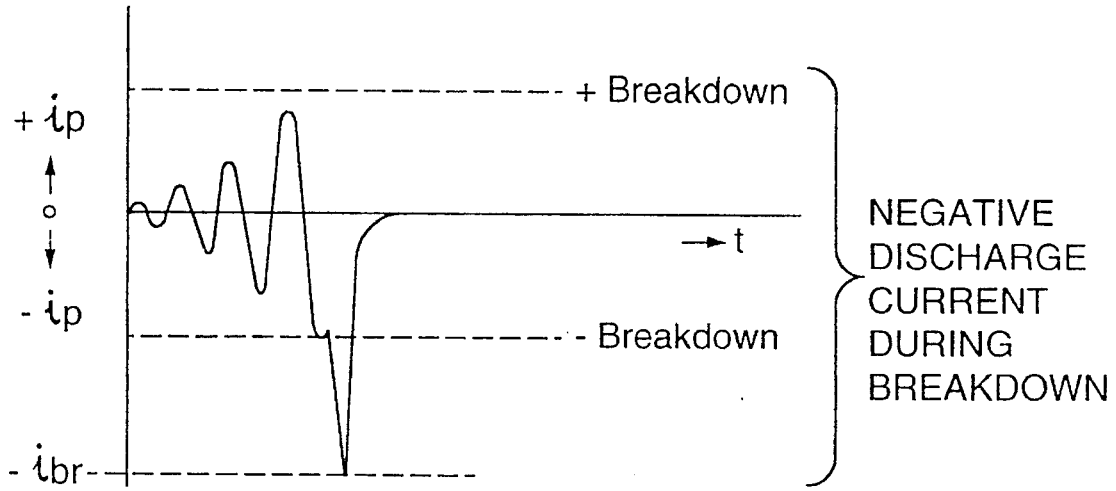
FIGS. 6A and 6B show the voltage waveform appearing at the output of the high voltage generator of FIGS. 4 and 5, in the event of breakdown mode being achieved during the positive half-cycle and the negative half-cycle of the high voltage signal, respectively.
Figure 6B:
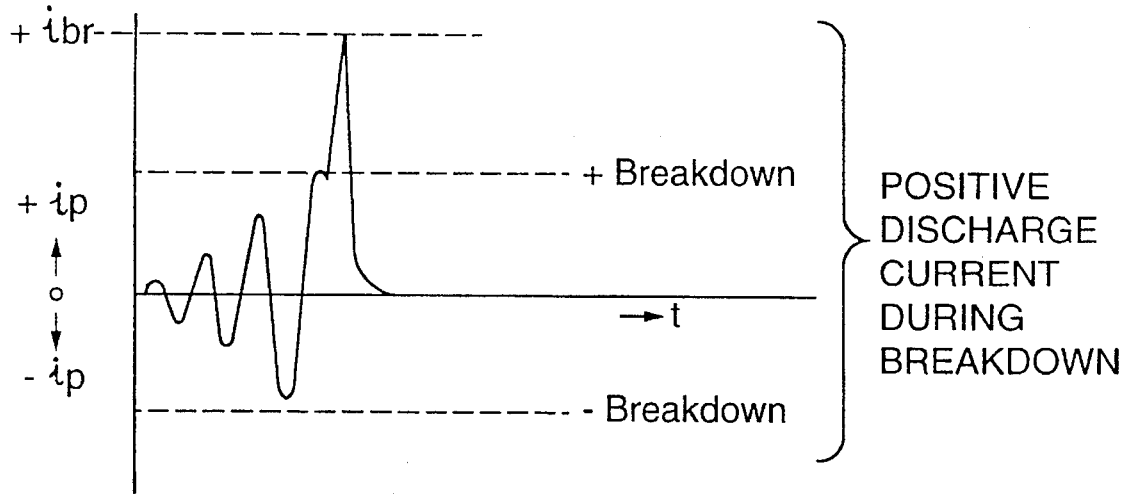
Figure 7:
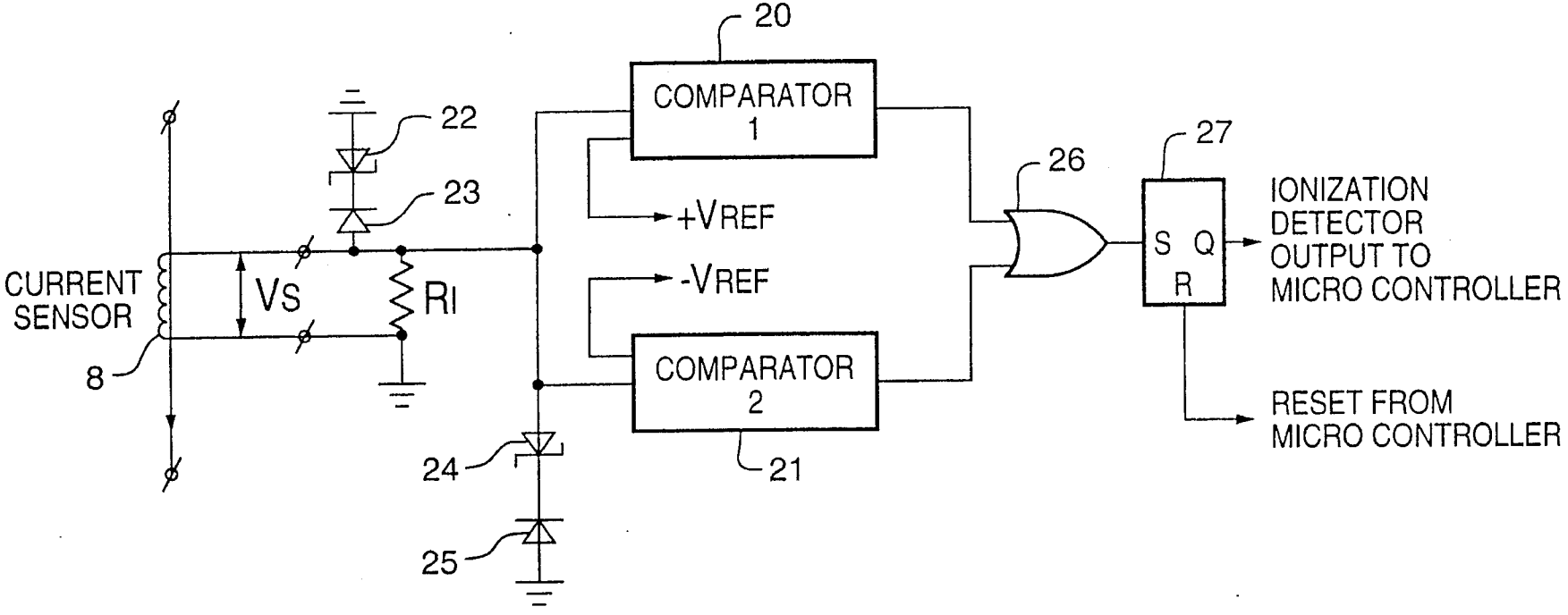
FIG. 7 is a schematic diagram of a bipolar ionization current detector of the plasma arc ignition system of FIG. 3, according to the preferred embodiment.
Figure 8A:
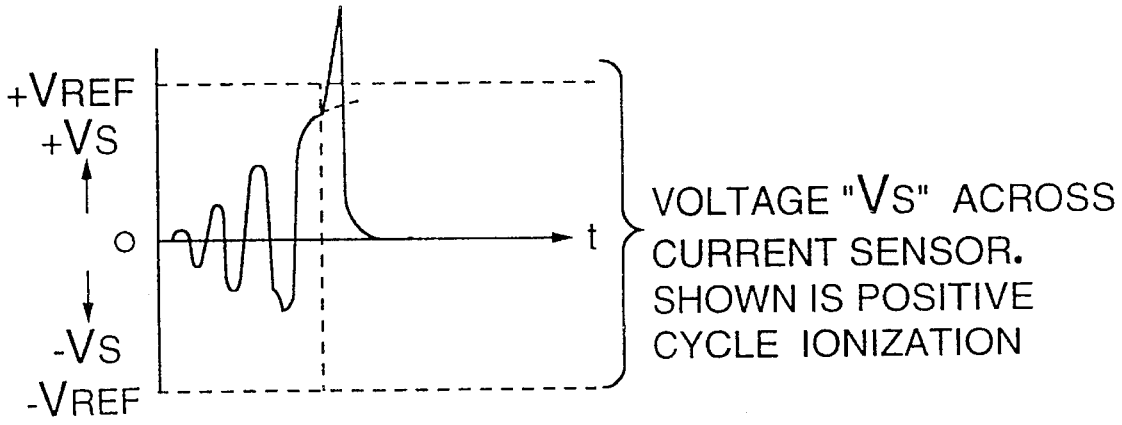
FIG. 8 shows the sequence of operations of the bipolar ionization current detector of FIG. 7.
Figure 8B:
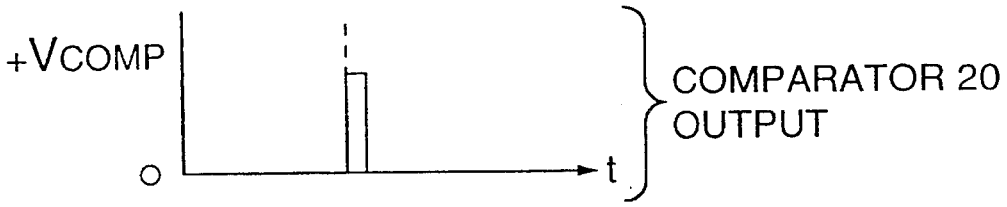
Figure 8C:
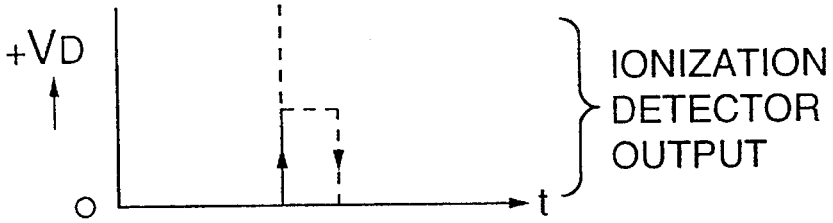
Figure 8D:
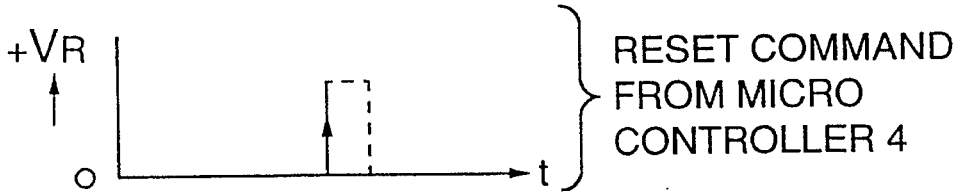

As discussed above, breakdown may take place during a positive or negative going half-cycle of the high voltage signal, as shown in FIGS. 6A and 6B, respectively. The breakdown or ionization current can thus be either positive or negative in sign. During breakdown, the resistance between the two electrodes of the plasma plug 6 changes rapidly and as a result, energy stored in the plug and cable stray capacitors will be discharged. As discussed above, the discharge of energy stored in the stray capacitors causes a significant momentary increase in the current supplied to the plasma plug 6, and can be uniquely detected by means of the bipolar ionization current detector 3, shown in FIG. 7.

The detector 3 of the preferred embodiment is in the form of a window comparator circuit which detects positive as well as negative voltage excursions above preset reference voltage levels (+Vref and −Vref). Since the voltage excursions can exceed the maximum allowable common mode input voltage of comparators 20 and 21, bipolar level detectors 22–25 are connected to the comparator inputs.

In response to detecting voltages having absolute value amplitudes in excess of +Vref or −Vref, the appropriate one of the comparators 20 and 21 generates an output signal which represents positive or negative discharge (ionization) current transients, respectively. The outputs of comparators 20 and 21 are connected to the inputs of an OR gate 26. Due to the fast transient nature of the discharge (ionization) current and the response time of the controller, the output of OR gate 26 must be temporarily stored in a set/reset flip flop 27. The output of flip flop 27 serves as a priority interrupt to the controller 4 for signifying that the breakdown process has taken place. Alternatively, the controller 4 may poll the input connected to ionization detector 3 in the foreground, for detection of a logic high output of flip flop 27. In response to receiving the priority interrupt (or in response to foreground polling of flip flop 27 for detecting a logic high output), the controller 4 switches off the sinusoidal signal oscillator 15 to the high voltage generator 1, switches on the plasma arc current generator 2, and resets the flip flop 27. The sequence of operations for a positive half-cycle induced breakdown, is shown in FIG. 8.

Figure 9:
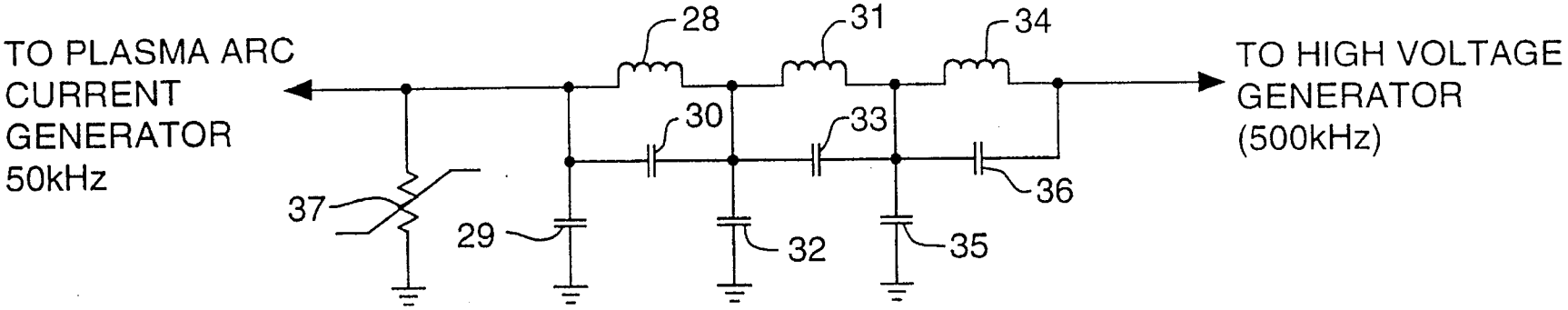
FIG. 9 is a schematic diagram of a high voltage blocking device of the plasma arc ignition system of FIG. 3, according to the preferred embodiment.

The high voltage blocking device 9 is shown in greater detail with reference to FIG. 9. The purpose of the high voltage blocking device 9 is to isolate the output of the plasma arc current generator 2 from the potentially damaging high voltage burst generated by high voltage generator 1. However, since 100 % isolation is not achievable, the output drivers of the plasma arc current generator 2 must nonetheless be designed to withstand considerable transients.

The high voltage blocking device 9 comprises at least three cascaded LC filter sections, the first section comprising inductor 28 and capacitors 29 and 30, the second section comprising inductor 31 and capacitors 32 and 33, and the third section comprising inductor 34 and capacitors 35 and 36. Each LC filter section provides about 20 dB (or 10×) attenuation. The total attenuation obtained with the configuration of FIG. 9 is approximately 60 dB (or 1000×), resulting in an attenuated voltage burst of about 40 V maximum at the output of the plasma arc current generator 2. Thus, the cascaded LC filter sections must also be designed to minimize loading the high voltage generator 1. To obtain maximum attenuation in the frequency domain, the ratio of frequency of operation of the high voltage generator 1 and plasma arc current generator 2 should be at least a factor of 10 (i.e. 500 kHZ/50 kHz).

In order to prevent potential damage from the attenuated high voltage burst, a metal oxide varistor 37 (voltage dependent resistor) is provided at the 50 kHZ input of the cascaded filter. The clamping level of varistor 37 is selected so as not to interfere with the reflected plasma arc voltage (Varc<100 V).

Figure 10:
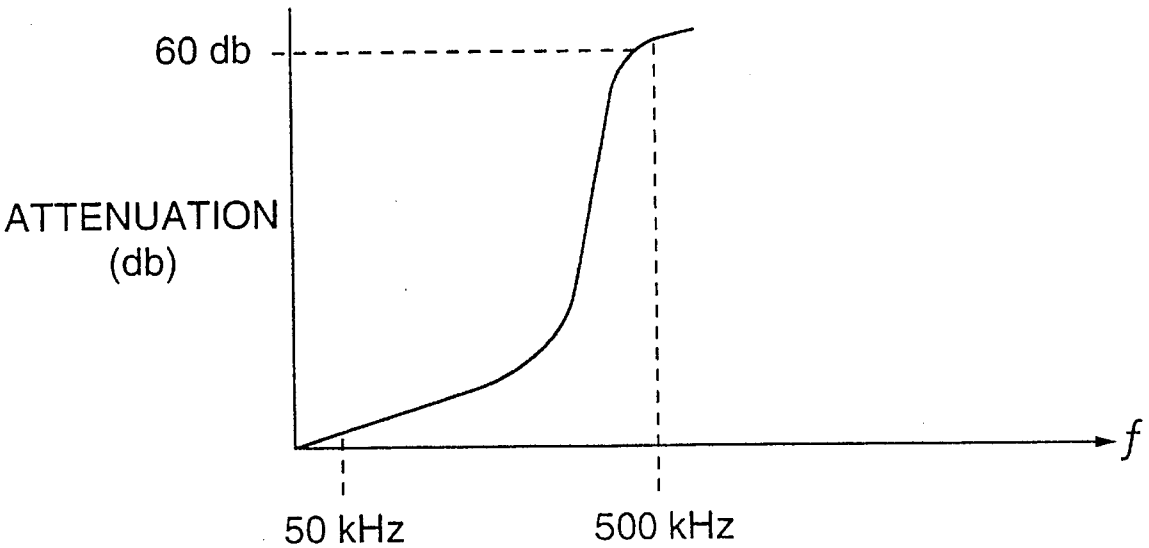
FIG. 10 is a plot of the frequency response of the high voltage blocking device of FIG. 9.

Due to the fact that the plasma arc impedance is very low (typically varying between 2 and 10 ohms), and is arc current magnitude dependent, the 50 kHZ pass band impedance of the filter must not be greater than 2 ohms, in order to obtain maximum energy transfer to the actual plasma arc. The frequency response for the high voltage blocking device of FIG. 9 is shown in FIG. 10.

As discussed above, the plasma arc current generator 2 supplies, upon demand, a pre-defined magnitude of current for a pre-defined period of time, defined by ignition and engine specific parameters.

Figure 11:
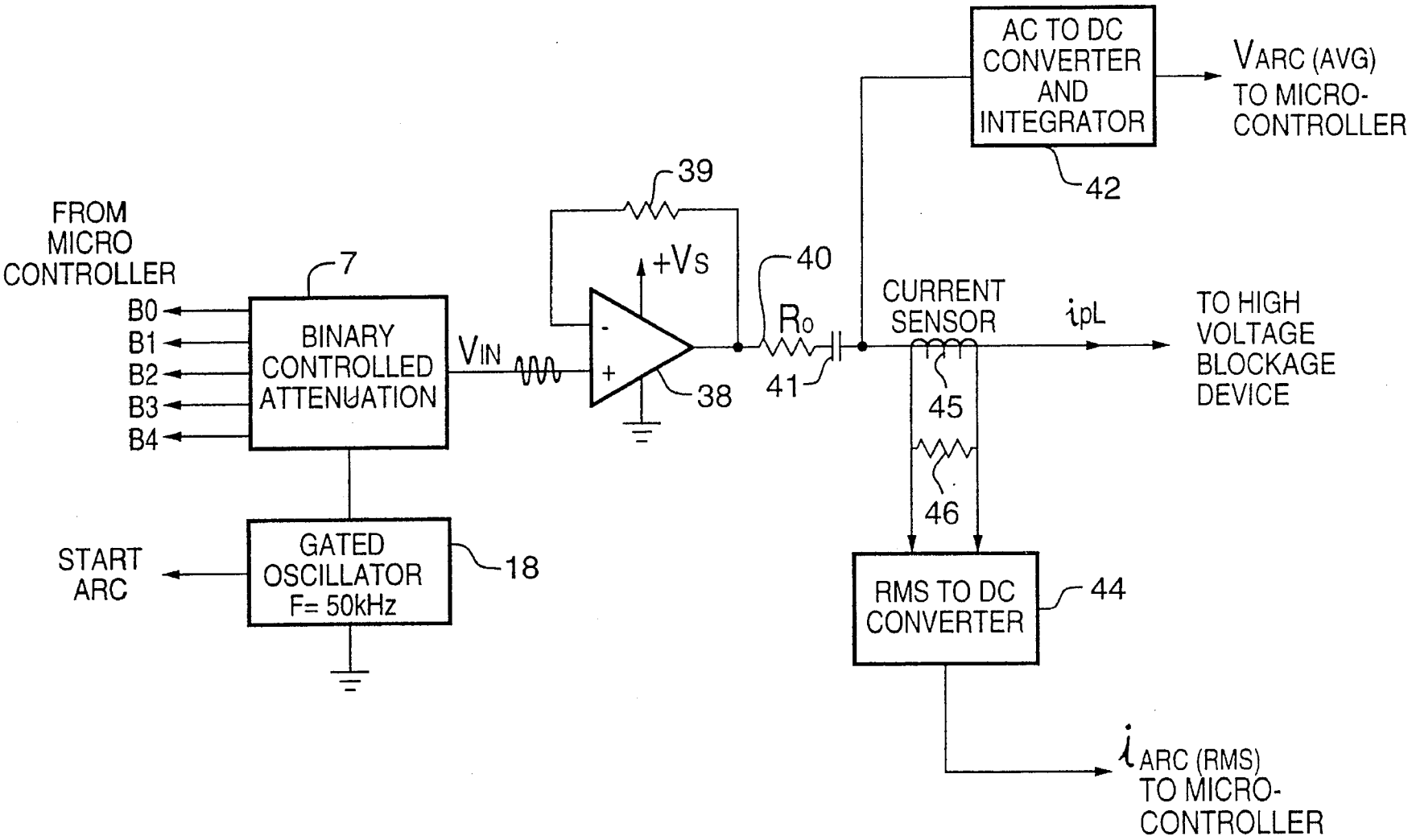
FIG. 11 is a schematic diagram of a plasma arc current generator of the plasma arc ignition system of FIG. 3, according to the preferred embodiment.

As shown in FIG. 11, the plasma arc current generator 2 is preferably configured as a Class B voltage controlled current source capable of supplying arc currents of up to 20 Amp RMS. The current generator comprises a power amplifier 38 having a feedback resistor 39, output resistor $R_0$ 40 and output coupling capacitor 41. One advantage of this configuration is that the magnitude of the plasma current to be supplied is independent of the magnitude of the arc voltage which, over a broad range of arc currents, is relatively constant.

The arc current generator 2 produces an output current which is directly proportional to the voltage magnitude of the input signal applied to the non-inverting input of power amplifier 38.

Since the arc resistance is dependent upon the magnitude of the arc current, the actual magnitude of the arc current is never known to any degree of certainty without an actual in-circuit measurement ($ipL=VinSin\omega t/(Ro+RpL)$), where Ro is the resistance of output resistor 40 and RpL is the variable plasma resistance. Furthermore, the arc resistance as a function of arc current is non-linear and varies with plasma plug electrode geometries.

To be able to regulate the amount of energy delivered to the arc as a function of the engine specific parameters, it is essential to determine to a reasonable accuracy, the magnitude of the arc current. Due to the fact that the arc voltage remains relatively constant over a wide range of arc currents, the energy to be delivered to the arc can be calculated as follows: Earc=ipl(rms)×Varc (RMS)×Tarc, where Tarc is the plasma arc period.

In spite of the fact that the arc current is sinusoidal, the arc voltage will exhibit a near squarewave wave like profile. However, tests have shown that the arc voltage will be subject to gradual variances as a function of electrode erosion and corrosion. In general, the arc voltage has been shown to exhibit a long term increase (eg. from 40 to 55 volts). If the long term variance of the arc voltage is not accounted for, an incorrect amount of energy would be delivered by the arc current generator 2.

To circumvent this problem, the controller 4 determines the actual reflected arc voltage, and implements a suitable algorithm in firmware for taking into account long term variances in the arc voltage. To measure the average arc voltage, an AC to DC converter coupled to an integrator 42 (FIG. 3) is provided.

During any ignition event, the actual arc energy packet is calculated and corrections are applied when required. An optional plasma plug failure display 43 (FIG. 3) can be incorporated, showing which plasma plug consistently fails to meet the specific operating parameters, thereby alerting the user that maintenance is required.

The failure criterion could, for example, be defined as ten failures in a row. To be able to measure the plasma arc current to an accuracy of about ±5 %, a fast RMS to DC converter 44 is connected across the parallel combination of a resistor 46 and a further current sensor 45 (eg. an inductive element such as a current transformer, Hall field effect detector, etc.). The output of the RMS to DC converter 44 is connected to an A-to-D converter, through a multiplexer, located on the controller 4. The DC level at the output of converter 4 is directly proportional to the root mean square value of the plasma arc current, thereby simplifying real time plasma arc energy calculations performed by the controller 4.

One significant advantage of the present invention is that, due to the unique design architecture, each plasma plug 6 is individually controlled regardless of differences in combustion chambers and plasma plug characteristics. Repeated failure to respond within preset limits may thus be reported to the user via an optional display 43.

Modifications and variations of the present invention are possible without departing from the sphere and scope of the invention as defined by the claims appended hereto.

We claim:

1. An ignition system for igniting an air/fuel mixture within an engine, said system comprising:

a) at least one ignition plug disposed in said engine, said ignition plug having a pair of electrodes;

b) high voltage generator means connected to said ignition plug for applying a gated high high frequency AC signal across a pair of electrodes so as to initiate ionization of said air/fuel mixture and create an infant plasma channel between said pair of electrodes;

c) plasma arc current generator means connected to said ignition plug for generating a predetermined amplitude of alternating current for a predetermined duration so as to sustain said plasma channel and ignite said air/fuel mixture;

d) controller means for selectively enabling and disabling said high voltage generator means and said plasma arc current generator means at predetermined times by adaptively controlling said predetermined amplitude and predetermined duration of said alternating current generated by said plasma arc current generator in accordance with more than one engine operation parameter; and e) a high voltage blocking circuit for isolating said plasma arc current generator means from said high voltage generator, wherein said high voltage blocking circuit comprises at least three cascaded LC filter sections.

2. The ignition system of claim 1, further comprising a bipolar ionization current detector connected to said high voltage generator means and said controller means for detecting initiation of said ionisation of said air/fuel mixture and in response enabling said plasma arc current generator means and causing said controller means to disable said high voltage generator means.

3. The ignition system of claim 1, wherein said high voltage generator means further comprises a high frequency oscillator connected to said controller means for receiving a control signal and in response generating a gated sinusoidal output signal of predetermined frequency, a transformer with capacitors on primary and secondary circuits thereof for tuning said transformer to said predetermined frequency, said transformer receiving said sinusoidal output signal and in response resonating at said predetermined frequency and generating said gated high voltage high frequency AC signal.

4. The ignition system of claim 3, wherein said predetermined frequency is approximately 500 kHz, but not limited to 500 kHz, and said high voltage is approximately 36 KV, but not limited to 36 KV.

5. The ignition system of claim 1, wherein said plasma arc current generator means further comprises gated oscillator for receiving a control signal from said controller means and in response generating a gated sinusoidal signal, a binary weighted attenuator connected to said controller means and said gated oscillator for receiving and attenuating said gated sinusoidal signal in response to said one or more engine operating parameters, and an amplifier for receiving said gated sinusoidal signal as attenuated by said binary weighted attenuator and in response generating said predetermined amplitude of alternating current for application to said ignition plug.

6. The ignition system of claim 5, wherein said sinusoidal signal is approximately 50 kHz, but not limited to 50 kHz.

7. The ignition system of claim 1 further comprising:

f) an AC to DC converter and integrator connected to the output of said plasma current generator means for averaging thermal arc voltage variances in said amplitude due to ignition plug corrosion and erosion during the plasma arc phase.

8. The ignition system of claim 1, further comprising:

an arc current sensor connected to f) an output of said plasma arc current generator means for sensing current output from said plasma arc current generator means and providing an indication of said current to said controller means for adaptively controlling said predetermined amplitude and predetermined duration of said alternating current generated by said plasma arc current generator.

9. The ignition system of claim 8, wherein said arc current sensor is a current transformer.

10. The ignition system of claim 8, wherein said arc current sensor is a Hall effect device.

11. The ignition system of claim 8, wherein said current sensor is connected to a RMS to DC converter for obtaining a DC signal having an amplitude which is proportional to the RMS (root means square) value of the plasma arc current, said DC signal being applied to said controller means for digitizing and further processing.

12. The ignition system of claim 8 further comprising a bipolar ionization current detector connected to said high voltage generator means and said controller means for detecting initiation of said ionization of said air/fuel mixture and in response enabling said plasma arc current generator means and causing said controller means to disable said high voltage generator means.

* * * * *